US012708158B2

(12) United States Patent
Croll

(10) Patent No.: US 12,708,158 B2
(45) Date of Patent: Aug. 18, 2026

(54) LATTICE STRUCTURE AND METHOD OF MANUFACTURE

(71) Applicant: UNKNOWN BEHAVIOURS LTD, Motherwell (GB)

(72) Inventor: Jessica Lee Croll, Pemberton (CA)

(73) Assignee: Unknown Behaviors Ltd., Motherwell (GB)

( * ) Notice: Subject to any disclaimer, the term of this patent is extended or adjusted under 35 U.S.C. 154(b) by 189 days.

(21) Appl. No.: 18/525,080

(22) Filed: Nov. 30, 2023

(65) Prior Publication Data

US 2024/0206572 A1 Jun. 27, 2024

Related U.S. Application Data

(60) Provisional application No. 63/434,761, filed on Dec. 22, 2022.

(51) Int. Cl.
*A41D 13/015* (2006.01)

(52) U.S. Cl.
CPC ..... *A41D 13/0153* (2013.01)

(58) Field of Classification Search
CPC ..... A41D 13/0153; A41D 13/015; A41D 13/065; A41D 31/28; A41D 13/0156; A63B 71/12; A63B 71/1225; A63B 2071/1208; A63B 2071/1233; A63B 2071/125; B32B 3/08; B32B 3/12; B32B 2459/00; B32B 2571/02
See application file for complete search history.

(56) References Cited

U.S. PATENT DOCUMENTS

| | | | | |
|---|---|---|---|---|
| 11,058,180 | B2 | 7/2021 | Lussier | |
| 2020/0154803 | A1 | 5/2020 | Goulet et al. | |
| 2022/0154803 | A1 | 5/2022 | Chiorino | |
| 2022/0225720 | A1* | 7/2022 | Frieder, Jr. | A42B 3/124 |
| 2022/0275845 | A1 | 9/2022 | Kabaria et al. | |
| 2023/0010873 | A1* | 1/2023 | Storey | A42B 3/124 |
| 2024/0000182 | A1* | 1/2024 | Weber | A42B 3/124 |

FOREIGN PATENT DOCUMENTS

| | | | |
|---|---|---|---|
| CN | 114919242 | A | 8/2022 |
| EP | 0549277 | A1 | 6/1993 |
| JP | 2006305774 | A | 11/2006 |
| WO | WO-2016179601 | A1 | 11/2016 |

OTHER PUBLICATIONS

McDavidUSA, "Hex® Protective Gear". Retrieved from the Internet at: <https://www.mcdavidusa.com/collections/hex?gclid=CjwKCAjwi8iXBhBeEiwAKbUofTmhNyJ0e9OPeL879C1B7cSIDriggQ3hFYWKyZkArJepKCjRFIM74RoCD7EQAvD_BWE> on Oct. 7, 2022.

* cited by examiner

*Primary Examiner* — Nathan L Van Sell
(74) *Attorney, Agent, or Firm* — MARSHALL, GERSTEIN & BORUN LLP

(57) ABSTRACT

A lattice structure includes a first layer and a second layer disposed on and overlaying the first layer. The first layer includes a plurality of interior cells, and adjacent interior cells along both a first axis and a second axis are interconnected. The second layer includes a plurality of exterior cells, and adjacent exterior cells are connected along the second axis but not the first axis. A channel is formed between unconnected adjacent exterior cells above interconnected adjacent interior cells. The lattice structure may be formed during a method of manufacturing a protective pad that further includes folding the lattice structure according to a pattern to form an articulated protective structure.

25 Claims, 14 Drawing Sheets

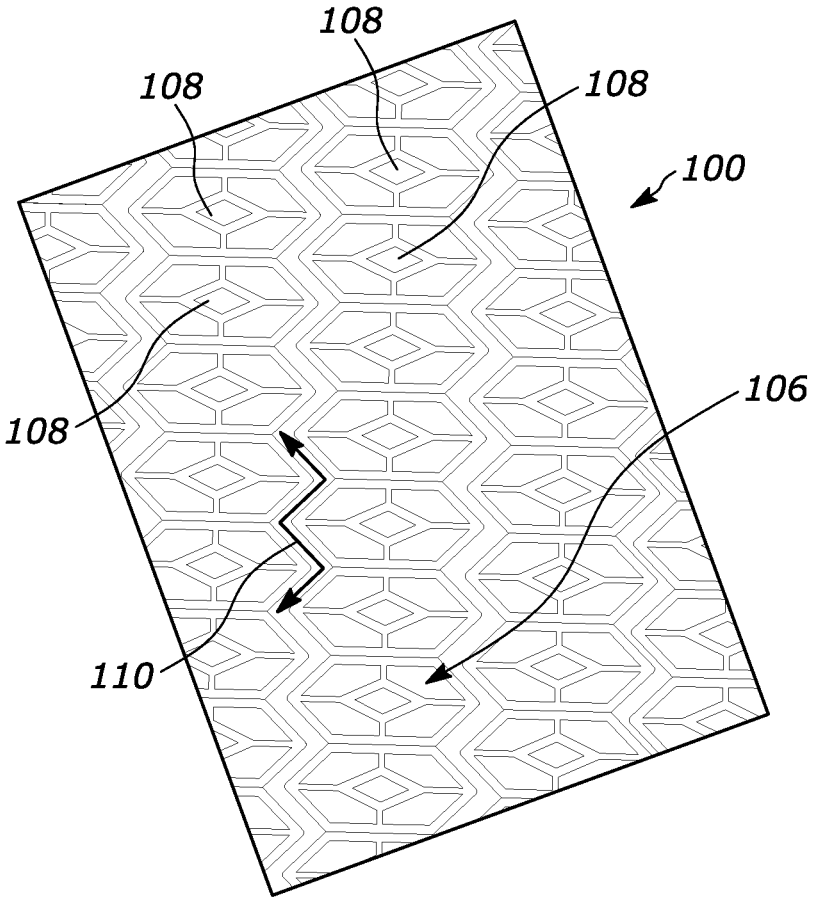
FIG. 3A
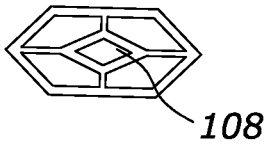
FIG. 3B
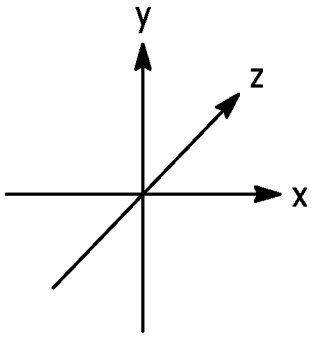

LATTICE STRUCTURE AND METHOD OF MANUFACTURE

CROSS-REFERENCE TO RELATED APPLICATION

The present application claims the benefit of priority the filing date of U.S. Provisional Application No. 63/434,761 filed Dec. 22, 2022, which is hereby incorporated herein by reference in its entirety.

FIELD OF THE DISCLOSURE

The present disclosure relates to a 3D printed lattice structure, and specifically relates to an open cell tubular lattice structure that, when incorporated into protective gear, provides air-permeable impact absorption with stretch and flexibility.

BACKGROUND

Various sports and professions involve activity that can cause soft-tissue damage or other injuries. For example, some sports involve high impact contact and collisions as a part of regular play (e.g., American football, ice hockey, and water polo). Even sports with limited or no player contact may involve a risk of collisions with equipment, a risk of crashing, or a risk of falling (e.g., baseball, skiing, and horseback riding). Professionals in certain industries, such as law enforcement, military, and construction, are also at risk for soft-tissue damage when performing their work duties.

Protective padding can reduce the risk of soft-tissue damage or other injuries, but traditional protective padding is hot, bulky, and can limit a wearer's mobility. Unless protective padding is required by sport or work regulations, many athletes and professionals opt to take the risk of injury rather than compromise their performance.

SUMMARY

In accordance with an example, a lattice structure includes a first layer, a second layer, and a channel. The first layer includes a plurality of interior cells arranged along a first axis and a second axis that is perpendicular to the first axis, adjacent interior cells along the first axis being interconnected and adjacent interior cells along the second axis being interconnected. The second layer is disposed on and overlays the first layer and is located above the first layer. The second layer includes a plurality of exterior cells arranged along the first axis and the second axis, adjacent exterior cells along the first axis being unconnected. The channel is formed between unconnected adjacent exterior cells above interconnected adjacent interior cells.

In some forms, adjacent exterior cells along the second axis may be interconnected.

In some forms, adjacent exterior cells along the second axis may be unconnected. The channel may be a first channel formed by the adjacent exterior cells along the first axis being unconnected. The lattice structure may further include a second channel formed by the adjacent exterior cells along the second axis being unconnected.

In some forms, each exterior cell may have an upper tubular frame and a lower tubular frame, the adjacent exterior cells along the second axis being interconnected by sharing a portion of the upper tubular frame that is oriented along the first axis and a portion of the lower tubular frame that is oriented along the first axis.

In some forms, the adjacent exterior cells along the first axis may be offset from one another along the second axis.

In some forms, the adjacent exterior cells along the second axis may be offset from one another along the first axis.

In some forms, each exterior cell may have an upper tubular frame and a lower tubular frame, a portion of the upper tubular fame and the lower tubular frame that is not oriented along the first axis defining a side of the channel.

In some forms, each interior cell may have a base tubular frame, the adjacent interior cells along the second axis being interconnected by sharing a portion of the base tubular frame that is oriented along the first axis.

In some forms, each interior cell may have a plurality of compound connections, each compound connection connected by a base tubular extension to a base eye, by a base segment to a base tubular frame, and by a joining tubular extension to a lower eye of an exterior cell, the compound connection defining a bottom of the channel.

In some forms, each exterior cell may have a central axis, an upper eye, upper tubular extensions, an upper tubular frame, a lower tubular frame, lower tubular extensions, and a lower eye. The upper eye may be defined by a tubular structure surrounding the central axis and having a first opening at the central axis. The upper eye may be positioned at a top of the second layer. The upper tubular extensions may be connected to the upper eye, and the upper tubular extensions may extend downward from the upper eye. The upper tubular frame may have upper segments. The upper segments may be connected to one another and to the upper tubular extensions at upper joints. The upper segments may be connected to one another and unconnected to the upper tubular extensions at frame connections. The upper joints may be disposed above the frame connections. The lower tubular frame may have lower segments. The lower segments may be connected to one another and to the upper segments at the frame connections. The lower segments may be connected to one another and unconnected to the upper segments at lower joints. The frame connections may be disposed above the lower joints. The lower tubular extensions may be connected to the lower tubular frame at the lower joints, and the lower tubular extensions may extend downward from the lower joints. The lower eye may be defined by a tubular structure surrounding the central axis and having a second opening at the central axis. The lower eye may be connected to the lower tubular extensions.

In some forms, each interior cell may have a central axis, a base eye, base tubular extensions, a base tubular frame, a dampening tubular frame, and joining tubular extensions. The base eye may be defined by a tubular structure surrounding the central axis and having a base opening at the central axis. The base eye may be positioned at a bottom of the first layer. The base tubular extensions may be connected to the base eye and extend upward. The base tubular frame may have base segments. The base segments may be connected only to one another and to the base tubular extensions at base joints. The dampening tubular frame may have dampening extensions. The dampening extensions may be connected to the base segments at base connections. The base connections may be disposed above the base joints, and joining tubular extensions may be configured to connect to the second layer. The joining tubular extensions may be connected to the dampening extensions at dampening joints. The dampening joints may be disposed above the base connections. The joining tubular extensions may be connected to the base segments and the base tubular extensions at compound connections.

In accordance with an example, a lattice structure includes a first layer, a second layer, and a channel. The first layer has a plurality of cells arranged along a first axis and a second axis that is perpendicular to the first axis, adjacent cells of the first layer along the first axis being interconnected and adjacent cells of the first layer along the second axis being interconnected. The second layer is disposed on and overlays the first layer, the second layer including a plurality of cells arranged along the first axis and the second axis, adjacent cells of the second layer along the first axis being unconnected. The channel is formed between unconnected adjacent cells of the second layer and interconnected adjacent cells of the first layer.

In some forms, adjacent cells of the second layer along the second axis may be interconnected.

In some forms, adjacent cells of the second layer along the second axis may be unconnected. The channel may be a first channel formed by the adjacent cells of the second layer along the first axis being unconnected. The lattice structure may further include a second channel formed by the adjacent cells of the second layer along the second axis being unconnected.

In some forms, the lattice structure may include a first area where adjacent cells of the second layer along the second axis are interconnected and a second area where adjacent cells of the second layer along the second axis are unconnected.

In some forms, each cell of the first layer may have an upper tubular frame and a lower tubular frame. The adjacent cells of the first layer along the second axis may be interconnected by sharing a portion of the upper tubular frame that is oriented along the first axis and a portion of the lower tubular frame that is oriented along the first axis.

In some forms, the adjacent cells of the first layer along the first axis may be offset from one another along the second axis.

In some forms, each cell of the first layer may have an upper tubular frame and a lower tubular frame. A portion of the upper tubular fame and the lower tubular frame that is not oriented along the first axis may define a side of the channel.

In some forms, each cell of the second layer may have a base tubular frame. The adjacent cells of the second layer along the second axis may be interconnected by sharing a portion of the base tubular frame that is oriented along the first axis.

In some forms, each cell of the second layer may have an upper tubular frame that is not shared with an adjacent cell and a lower tubular frame that is not shared with an adjacent cell.

In some forms, each cell of the second layer may have a plurality of compound connections. Each compound connection may be connected by a base tubular extension to a base eye, by a base segment to a base tubular frame, and by a joining tubular extension to a lower eye of a cell of the first layer. The compound connection may define a bottom of the channel.

In accordance with an example, a method of manufacturing a protective pad including a lattice structure includes identifying a pattern for a lattice structure to facilitate folding the lattice structure to form an articulated protective structure. The method further includes forming a lattice structure by additive manufacturing according to the pattern. The lattice structure includes a first layer including a plurality of interior cells, a second layer disposed on and overlaying the first layer and including a plurality of exterior cells, and a plurality of channels formed between unconnected adjacent exterior cells above interconnected adjacent interior cells. The method further includes folding the lattice structure according to the pattern to form the articulated protective structure.

In some forms, the articulated protective structure may be configured to protect a human body part.

In some forms, the pattern may include tabs for connecting areas of the lattice structuring during folding.

In some forms, the articulated protective structure may be secured within a garment.

In some forms, the method may include securing the lattice structure within a housing comprising air-permeable fabric. The air-permeable fabric may be mesh.

BRIEF DESCRIPTION OF THE DRAWINGS

The figures described herein depict various aspects of the system and methods disclosed herein. It should be understood that each figure depicts an example of aspects of the present systems and methods.

FIG. 3A is a top view of a portion of a first layer of the first anisotropic lattice structure of FIG. 1.

FIG. 3B is a top view of an exterior cell of the second layer of FIG. 3A.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

The disclosed lattice structure may be 3D printed using elastomers that provide sufficient stability for open cell tubular lattices. The open cells allow air flow, thereby preventing overheating. Another result of the open tubular cells is that the lattice structure is lightweight. The dual layer arrangement and channel provides impact protection while simultaneously allowing the lattice structure to flex with the wearer's body, thereby limiting the impact on a wearer's range of motion. The lattice structure can be warped to contour to various body parts. Because the lattice structure is 3D printed, diversity in sizing can be achieved without significant increases in cost. For example, typical bra cups require expensive molds for foam cups. In contrast, a 3D printed bra cup using the disclosed lattice structure requires no such molds and can be offered in a variety of sizes to better fit diverse chest contours. The lattice structure may be manufactured using a custom material stiffness for the particular application desired, and the material may be biocompatible to limit the environmental impact.

Figure 1:
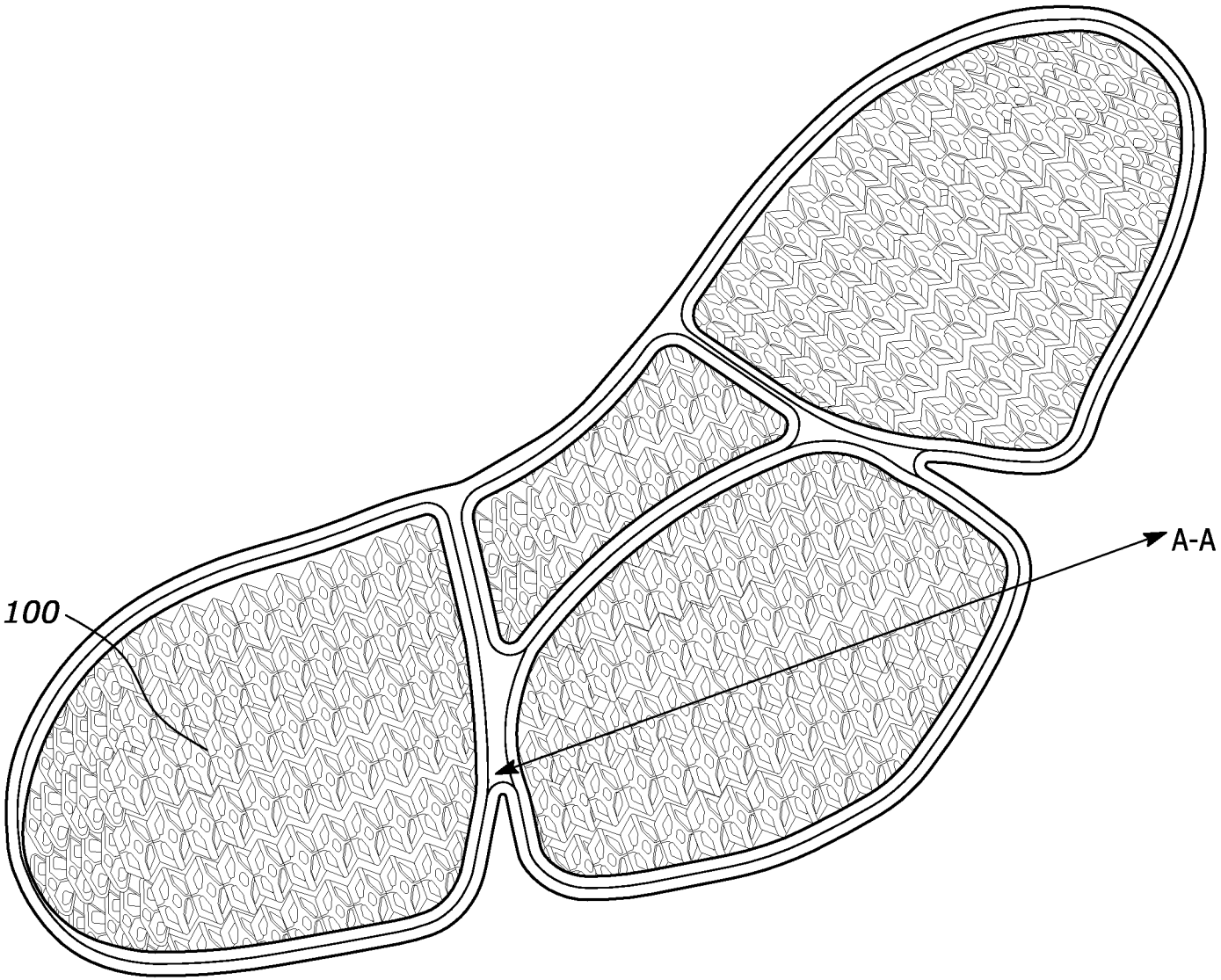
FIG. 1 is a top view of a first anisotropic lattice structure for protective gear prior to folding and jointing.

FIG. 1 is a top view of a first anisotropic lattice structure 100 for protective gear prior to folding and jointing. The first lattice structure 100 may be used in a variety of applications. For example, the first lattice structure 100 may be used in modular base layers, such as chest cups, pelvic cups, rib pads, and hip pads. The first lattice structure 100 may be incorporated as a breast cup in an impact bra. The first lattice structure 100 may be used in a strike plate, such as a chest plate, back plate, or side plate. The first lattice structure 100 may be folded to form protective padding and/or may be incorporated into a garment comprising other materials.

Figure 2A:
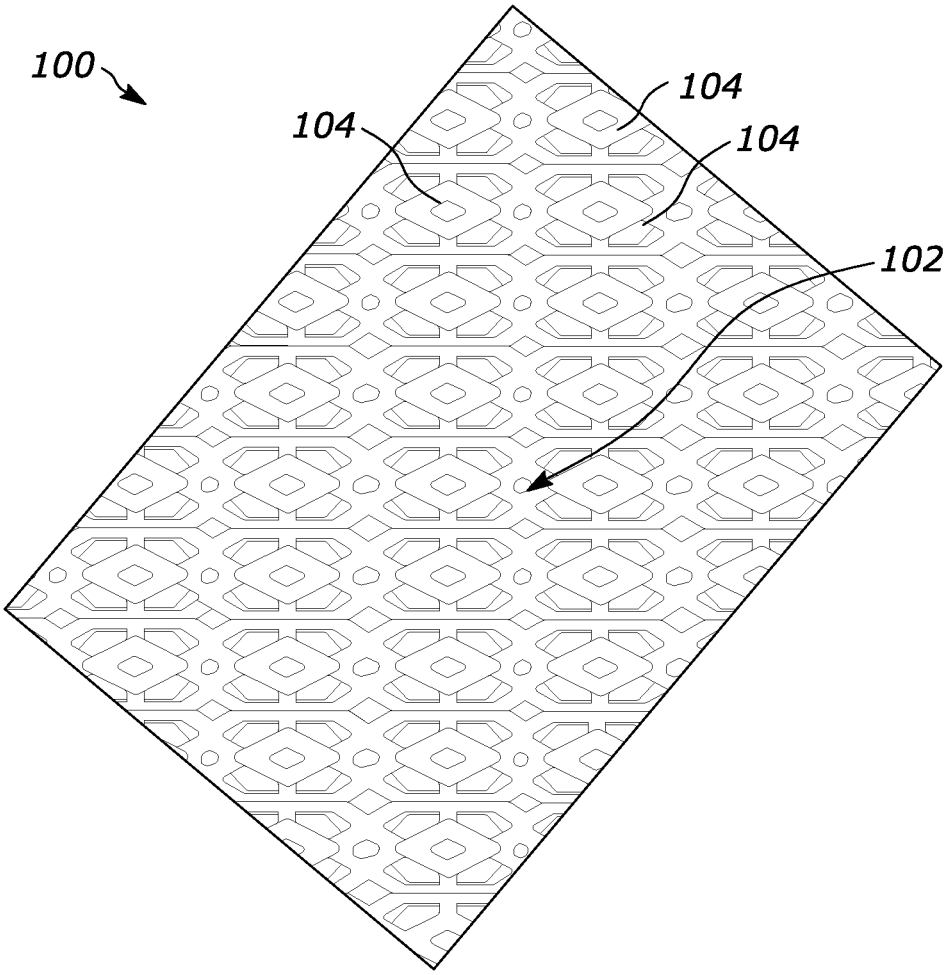
FIG. 2A is a bottom view of a portion of a first layer of the first anisotropic lattice structure of FIG. 1.
Figure 2B:
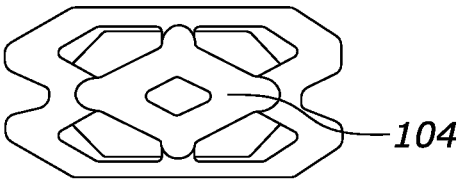
FIG. 2B is a bottom view of an interior cell of the first layer of FIG. 2A.
Figure 2B:
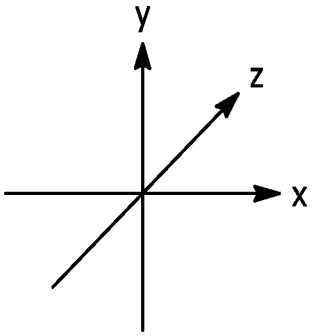

FIG. 2A is a bottom view of a portion of a first layer 102 of the first anisotropic lattice structure 100 of FIG. 1. The first layer 102 would typically be placed next to or closest to the skin of a wearer when the first lattice structure 100 is incorporated into protective gear. The first layer 102 includes a plurality of interior cells 104. FIG. 2B illustrates a bottom view of an interior cell 104 of the first layer 102. As shown in FIG. 2A, the plurality of interior cells 104 are arranged along a first axis (the x-axis) and a second axis (the y-axis) that is perpendicular to the first axis. Adjacent interior cells 104 along the first axis are interconnected and adjacent interior cells along the second axis are interconnected. Because the adjacent interior cells 104 are connected along both the first axis and the second axis, the first layer 102 provides stability for the first lattice structure 100.

FIG. 3A is a top view of a second layer 106 of the first anisotropic lattice structure 100 of FIG. 1. The second layer 106 is disposed on and overlays the first layer 102 (shown in FIG. 2A). The second layer 106 is located above the first layer 102 on a third axis (the z-axis) that is perpendicular to both the first axis (the x-axis) and the second axis (the y-axis). The second layer 106 includes a plurality of exterior cells 108 arranged along the first axis and the second axis. FIG. 3B is a top view of an exterior cell 108 of the second layer 106 of FIG. 3A. As shown in FIG. 3A, adjacent exterior cells 108 along the first axis are unconnected and adjacent exterior cells 108 along the second axis are interconnected. A channel 110 is formed between unconnected adjacent exterior cells 108 above interconnected adjacent interior cells 104 (shown in FIG. 2A). In some arrangements, adjacent exterior cells 108 along the second axis may be unconnected in order to increase flexibility in certain regions of the first lattice structure 100. When the adjacent exterior cells 108 are arranged as shown in FIG. 3A, the channel 110 has a zig-zag pattern. The channel 110 allows the second layer 106 some freedom of movement along both the first and second axes, thereby providing flexibility within the first lattice structure 100.

Figure 4A:
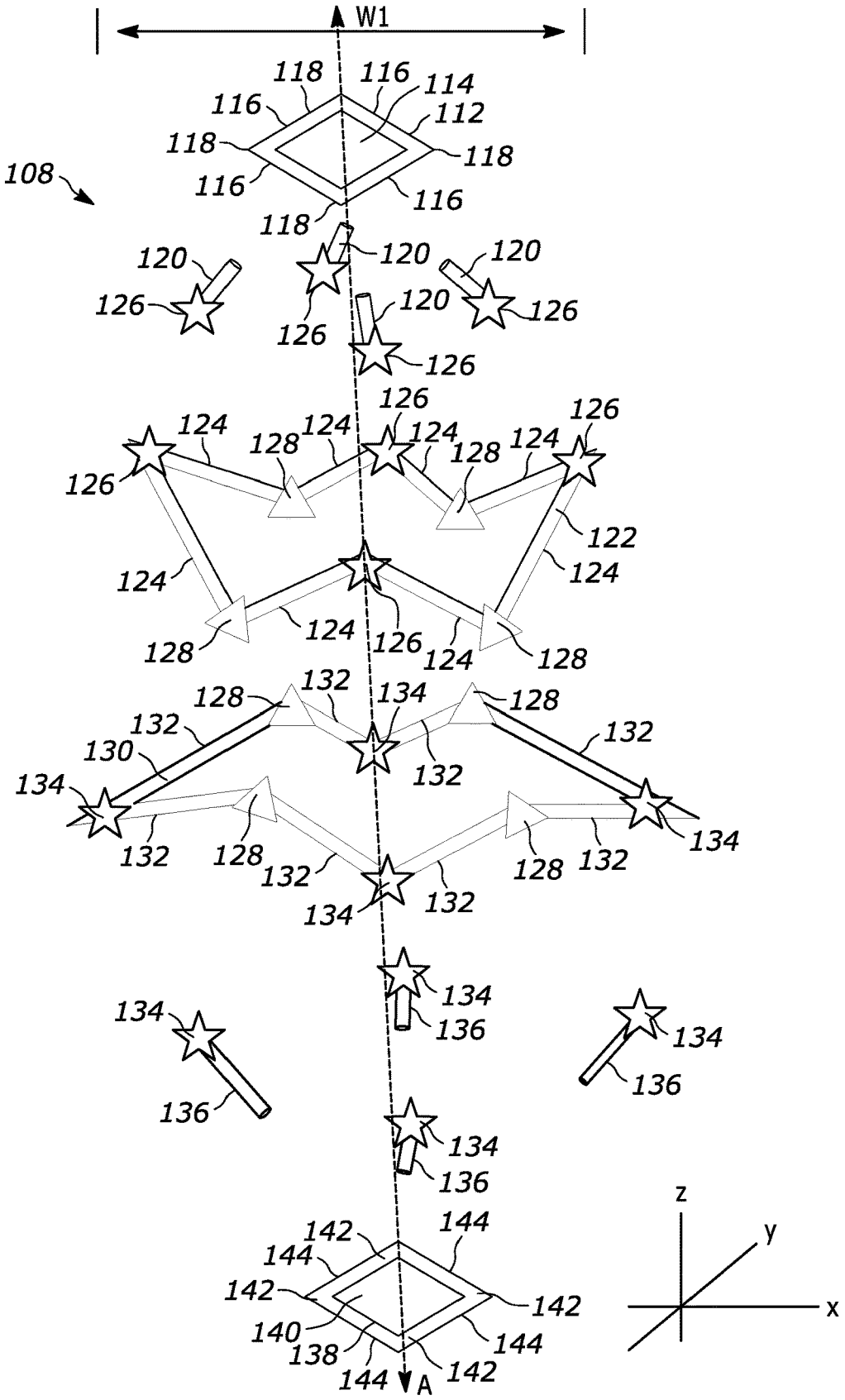
FIG. 4A is an exploded view of the exterior cell of FIG. 3B.

FIG. 4A is an exploded view of the exterior cell 108 of FIG. 3B along the third axis (the z-axis). The exterior cell 108 has a central axis A extending along the third axis. The size of the exterior cell 108 (for example, the width W1 relative to the central axis A) may be larger or smaller within certain regions or depths of the first lattice structure 100. An upper eye 112 is defined by a tubular structure surrounding the central axis A. The upper eye 112 has a first opening 114 at the central axis A. In the arrangement shown, the upper eye has four sides 116 that each meet at upper eye junctures 118. The upper eye 112 is positioned at a top of the second layer 106. Upper tubular extensions 120 are connected to the upper eye 112. The upper tubular extensions 120 extend downward from the upper eye 112. In the arrangement shown, four upper tubular extensions 120 are connected at the upper eye junctures 118, two of the four upper tubular extensions 120 extending outward from the upper eye 112 along the first axis and the other two of the four upper tubular extensions 120 extending outward from the upper eye 112 along the second axis.

As shown in FIG. 4A, the exterior cell 108 has an upper tubular frame 122 having upper segments 124. In the arrangement shown, the upper tubular frame 122 has eight upper segments 124. The upper segments 124 are connected to one another and to the upper tubular extensions 120 at upper joints 126. In the arrangement shown, the upper tubular frame 122 has four upper joints 126. The upper segments 124 are connected to one another and unconnected to the upper tubular extensions 120 and frame connections 128. In the arrangement shown, the upper tubular frame 122 has four frame connections 128. The upper joints 126 are disposed above the frame connections 128. During impact, the upper joints 126 and the frame connections 128 may become at least partially interlocked, helping to absorb the impact and distribute the load across the second layer 106.

The exterior cell 108 also has a lower tubular frame 130 having lower segments 132. The lower segments 132 are connected to one another and to the upper segments 124 at the frame connections 128. The lower segments 132 are connected to one another and unconnected to the upper segments 124 at lower joints 134. In the arrangement shown, the lower tubular frame 130 has four lower joints 134. The frame connections 128 are disposed above the lower joints 134. In the arrangement shown, the lower tubular frame 130 and the upper tubular frame 122 are coplanar along the third axis. That is, each lower segment 132 is aligned with a respective upper segment 124 such that the exterior cell 108, when viewed from the top as shown in FIG. 4C, appears to have only one frame because the upper tubular frame 122 covers all of the lower tubular frame 130.

As shown in FIG. 4A, lower tubular extensions 136 are connected to the lower tubular frame 130 at the lower joints 134. The lower tubular extensions 136 extend downward from the lower joints 134. In the arrangement shown, the exterior cell 108 has four lower tubular extensions 136, two of the four lower tubular extensions 136 extending inward from the lower tubular frame 130 along the first axis and the other two of the four upper tubular extensions 136 extending inward from the lower tubular frame 130 along the second axis. The two of the four lower tubular extensions 136 extending inward along the first axis are coplanar (in the x-z plane) with respective two of the four upper tubular extensions 120. The other two of the four lower tubular extensions 136 extending inward along the second axis are coplanar (in the y-z plane). A lower eye 138 is defined by a tubular structure surrounding the central axis A and having a second opening 140 at the central axis. The lower eye 138 is connected to the lower tubular extensions 136 at lower eye junctures 142. In the arrangement shown, the lower eye 138 has four sides 144.

Figure 4B:
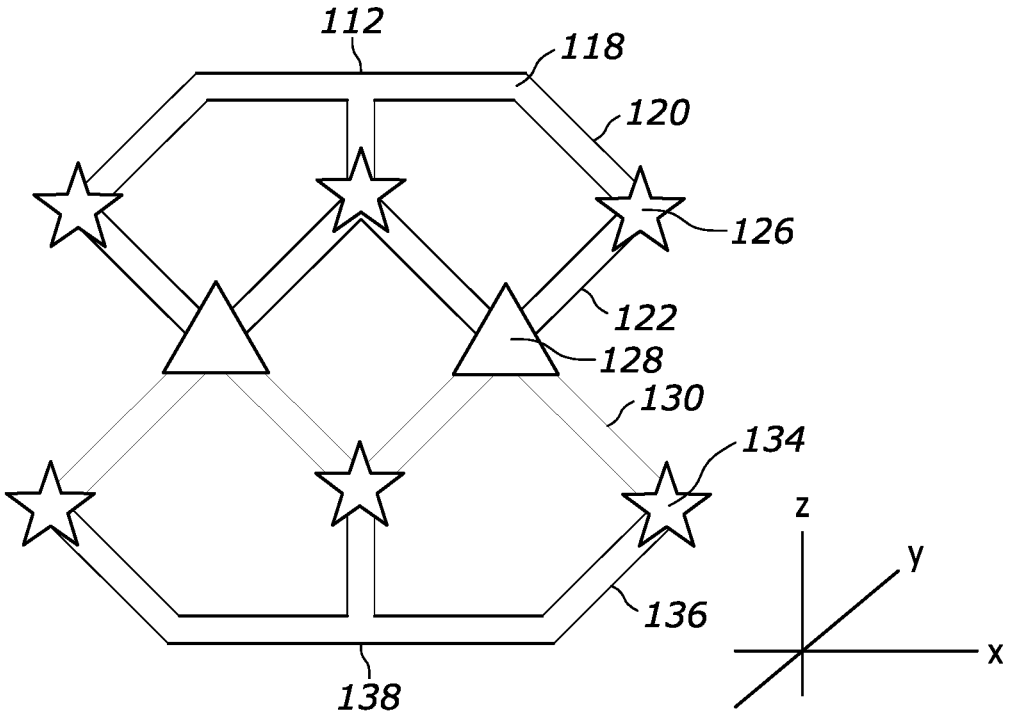
FIG. 4B is a side view of the exterior cell of FIGS. 3B and 4A.
Figure 4C:
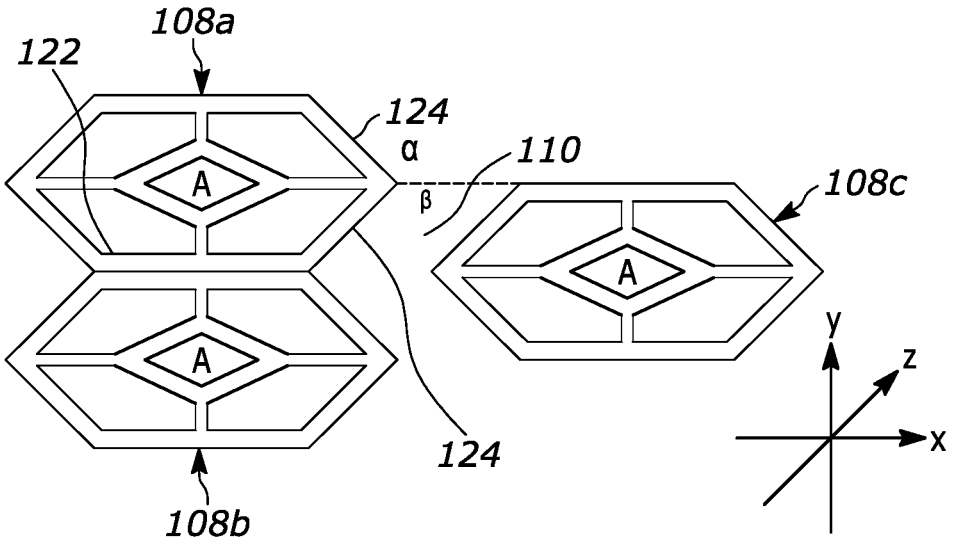
FIG. 4C is a top view of the exterior cell of FIGS. 3B, 4A, and 4B illustrating placement of the exterior cell relative to other exterior cells.

FIG. 4B is a side view of the exterior cell of FIGS. 3B and 4A. FIG. 4C is a top view of the exterior cell of FIGS. 3B and 4A illustrating placement of the exterior cell 108, 108*a* relative to other exterior cells 108*b*, 108*c*. As shown in FIG. 4C, a first exterior cell 108*a* is adjacent a second exterior cell 108*b* along the first axis and is adjacent a third exterior cell 108*c* along the second axis. The adjacent exterior cells 108*a* and 108*b* along the first axis are offset from one another along the second axis. That is, the central axis A of the first exterior cell 108*a* is offset along the second axis from the central axis A of the second exterior cell 108*b*. The staggering of the exterior cells 108*a* and 108*b* improves the stretch of the first lattice structure 100 while simultaneously providing adequate coverage for protection. The adjacent exterior cells 108*a* and 108*c* along the second axis are interconnected by sharing a portion of the upper tubular frame 122 that is oriented along the first axis and a portion of the lower tubular frame 130 (shown in FIGS. 4A and 4B) that is oriented along the first axis. For each of the exterior cells 108*a*, 108*b*, 108*c*, a portion of the respective upper tubular fame 122 and respective lower tubular frame 130 that is not oriented along the first axis defines a side of the channel 110. In particular, as shown in FIG. 4C, the side of the channel 110 is defined by a first upper segment 124 and a first lower segment 132 (shown in FIGS. 4A and 4B) coplanar along the third axis and disposed at a first angle $\alpha$ relative to the first axis of exterior cell 108*a*. As also shown in FIG. 4C, the side of the channel 110 is further defined by a second upper segment 124 and a second lower segment 132 (shown in FIGS. 4A and 4B) coplanar along the third axis and disposed at a second angle $\beta$ relative to the first axis.

Figure 5A:
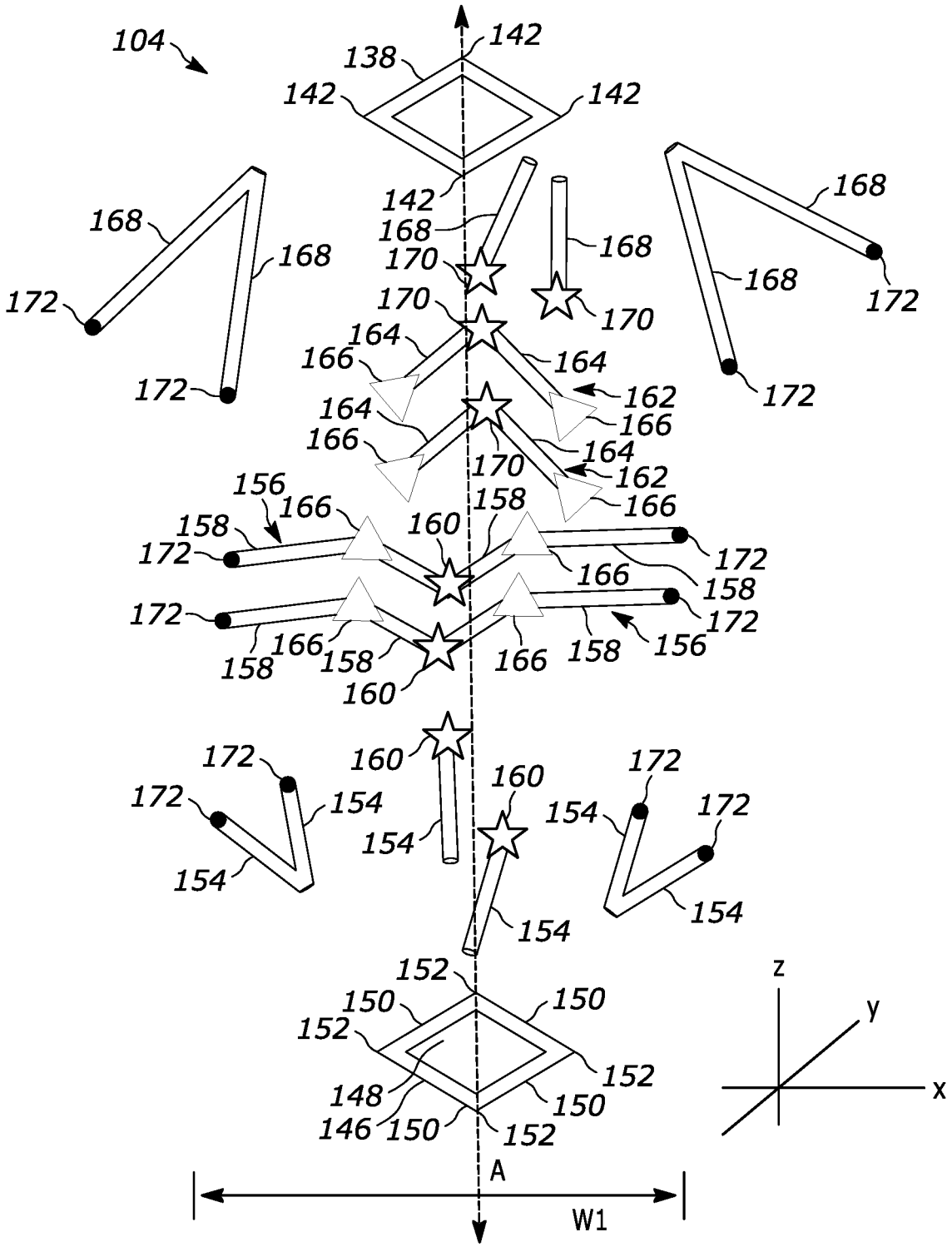
FIG. 5A is an exploded view of the interior cell of FIG. 2B.

FIG. 5A is an exploded view of the interior cell 104 of FIG. 2B along the third axis (the z-axis). The interior cell 104 has a central axis A. The size of the interior cell 104 (for example, the width W2 relative to the central axis A) may be larger or smaller within certain regions or depths of the first lattice structure 100. A base eye 146 defined by a tubular structure surrounds the central axis A. The base eye 146 has a base opening 148 at the central axis A. In the arrangement shown, the base eye 146 has four sides 150 that each meet at base eye junctures 152. The base eye 146 is positioned at a bottom of the first layer 102. Base tubular extensions 154 connect to the base eye 146 and extend upward. In the arrangement shown, six base tubular extensions 154 are connected to the base eye 146. At two of the base eye junctures 152, two of the six base tubular extensions 154 are connected and extend outward from the base eye 146 at angles relative to the first axis. At two of the base eye junctures 152, just one of the six base tubular extensions 154 are connected and extend outward from the base eye 146 along the second axis.

As shown in FIG. 5A, a base tubular frame 156 has base segments 158. The base segments 158 are connected only to one another and to the base tubular extensions 154 at base joints 160. A dampening tubular frame 162 has dampening extensions 164. The dampening extensions 164 are connected to the base segments 158 at base connections 166 that are disposed above the base joints 160.

Joining tubular extensions 168 are configured to connect to the second layer 106. Specifically, the joining tubular extensions 168 are configured to connect to the lower eye junctures 142 of the lower eye 138. The arrangement shown has six joining tubular extensions 168. At two of the lower eye junctures 142, two of the six joining tubular extensions 168 are configured to connect and to extend outward from the lower eye 138 at angles relative to the first axis. At two of the lower eye junctures 142, just one of the six joining tubular extensions 168 are configured to connect and extend outward from the lower eye 138 along the second axis. The joining tubular extensions 168 are connected to the dampening extensions 164 at dampening joints 170. The dampening joints 170 are disposed above the base connections 166.

The joining tubular extensions 168 are connected to the base segments 158 and the base tubular extensions 154 at compound connections 172. Each compound connection 172 is connected by a base tubular extension 154 to the base eye 146, by a base segment 158 to the base tubular frame 156, and by a joining tubular extension 168 to the lower eye 138 of an exterior cell 108, and each compound connection 172 defines a bottom of the channel 110.

Figure 5B:
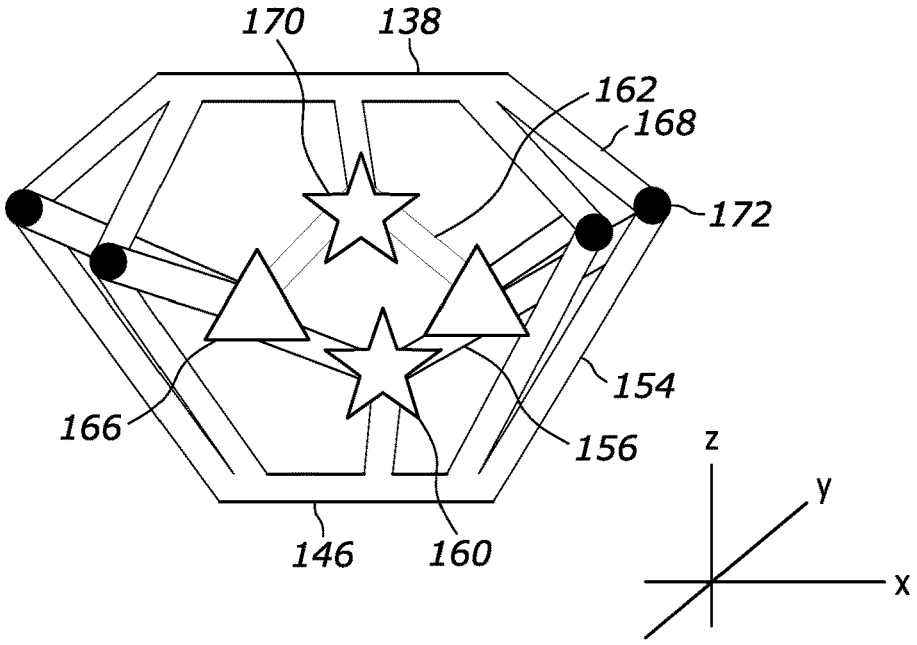
FIG. 5B is a side view of the exterior cell of FIGS. 2B and 5A.
Figure 5C:
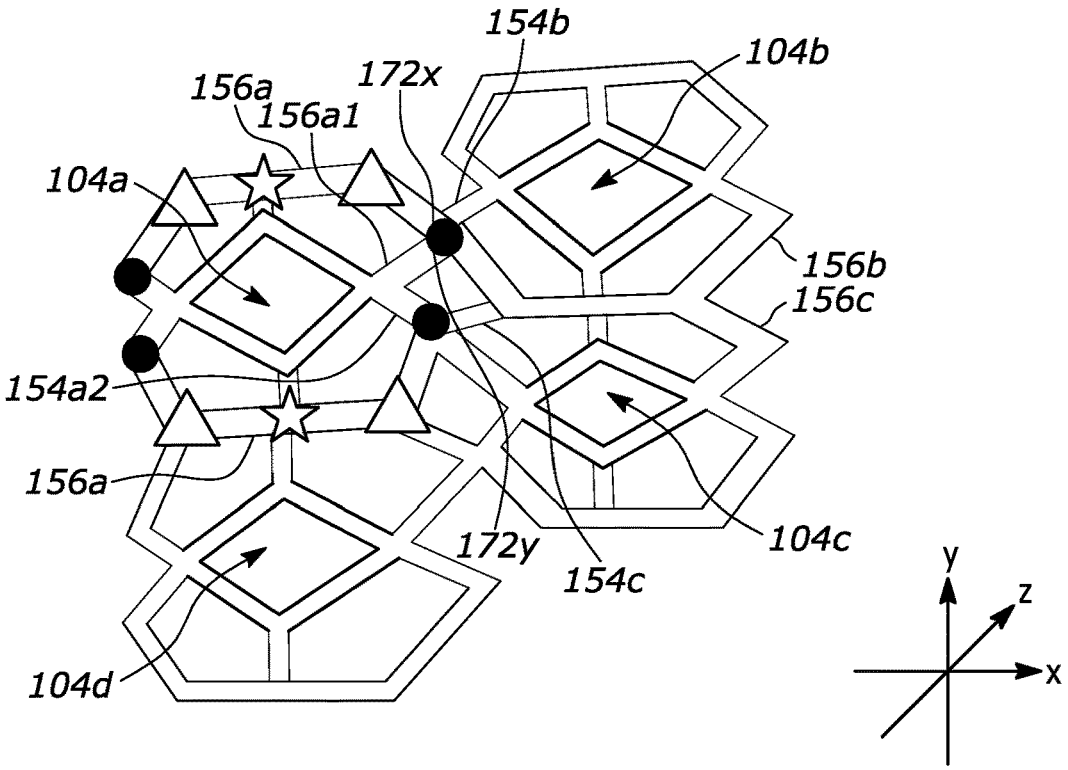
FIG. 5C is a bottom view of the interior cell of FIGS. 2B, 5A, and 5B illustrating placement of the interior cell relative to other interior cells.

FIG. 5B is a side view of the exterior cell of FIGS. 2B and 5A. FIG. 5C is a bottom view of the interior cell 104 of FIGS. 2B, 5A, and 5B illustrating placement of an interior cell 104, 104*a* relative to other interior cells 104, 104*b*, 104*c*, 104*d*. Specifically, FIG. 5C shows a first interior cell 104*a* beside a second interior cell 104*b* along the first axis, beside a third interior cell 104*c* along the first axis, and beside a fourth interior cell 104*d* along the second axis. The base tubular frame 156*a* of the first interior cell 104*a* is interconnected with the base tubular frame 156*b* second interior cell 104*b* by sharing a compound connection 172*x*, and the base tubular frame 156*a* of the first interior cell 104*a* is interconnected with the base tubular frame 156*c* of the third interior cell 104*c* by sharing a compound connection 172*y*. The compound connection 172*x* is further connected to a base tubular extension 154*a*1 of the first interior cell, a base tubular extension 154*b* of the second interior cell, a joining tubular extension 168 of the first interior cell 104*a* (see FIG. 5A), and a joining tubular extension 168 of the second interior cell 104*b* (see FIG. 5A). The compound connection 172*y* is further connected to a base tubular extension 154*a*2 of the first interior cell 104*a*, a base tubular extension 154*c* of the third interior cell 104*c*, a joining tubular extension 168 of the first interior cell 104*a* (see FIG. 5A), and a joining tubular extension 168 (see FIG. 5A) of the third interior cell 104*c*. A portion of the base tubular frame 156*a* of the first interior cell 104*a* that is oriented along the first axis is shared with the fourth interior cell 104*d*.

Figure 6:
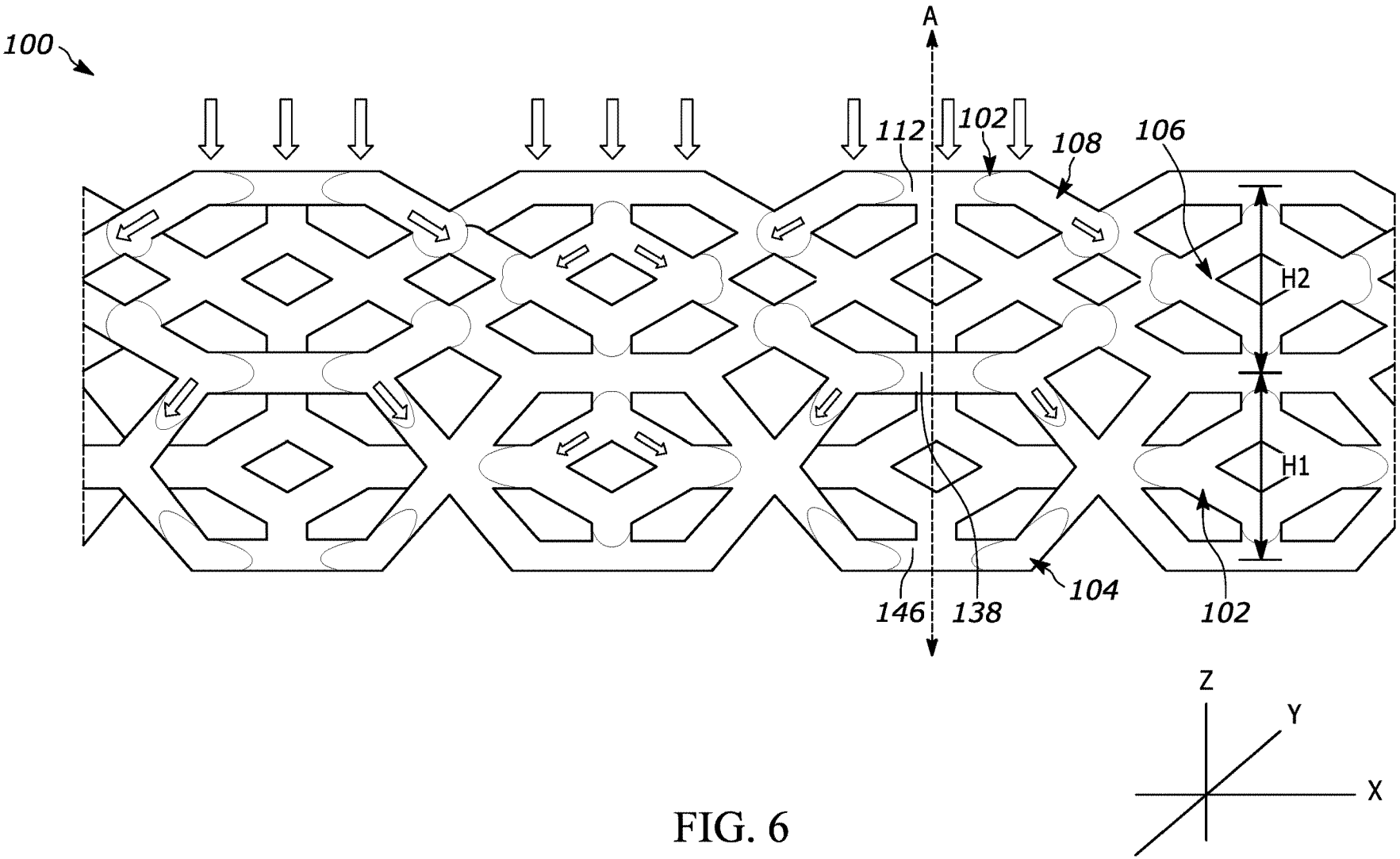
FIG. 6 is a cross-sectional view of the first anisotropic lattice structure of FIG. 1 taken along the line A-A of FIG. 1.

FIG. 6 is a cross-sectional view of the first anisotropic lattice structure 100 of FIG. 1. The central axis A of an interior cell 104 is aligned with the central axis A of an exterior cell 108. The base eye 146 is positioned below the lower eye 138 and the lower eye 138 is positioned below the upper eye 112. As shown by the arrows, a force applied to the first layer 102 (including the exterior cell 108) is distributed throughout the first lattice structure 100, enabling the first lattice structure 100 to distribute and dissipate the impact force over the entire area of the first lattice structure 100. The first layer 102 has a first height H1, and the second layer 104 has a second height H2. In the arrangement shown, the first height H1 and the second height H2 are substantially the same. In other arrangements, the first height H1 and the second H2 may differ.

Figure 7A:
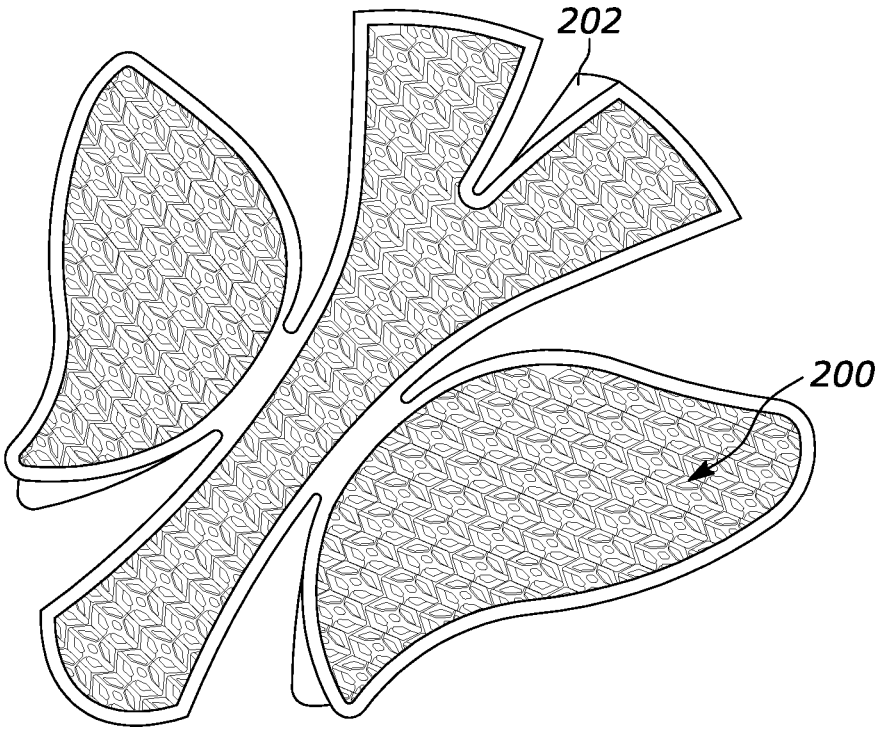
FIG. 7A is an isometric view of an anisotropic lattice structure for groin protection prior to folding and jointing.
Figure 7B:
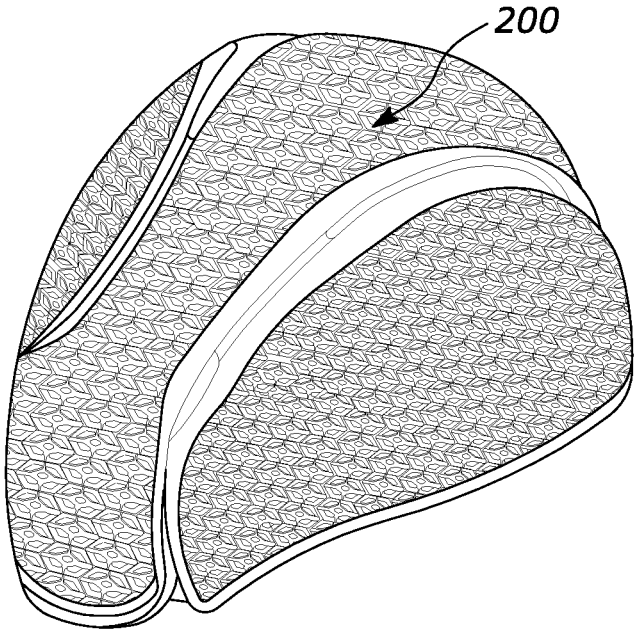
FIG. 7B is an isometric view of the anisotropic lattice structure of FIG. 7A after folding and jointing.

FIG. 7A is an isometric view of a lattice structure 200 for groin protection prior to folding and jointing. As shown, the anisotropic lattice structure 200 includes tabs 202 for securing the lattice structure 200 during in a folded configuration. FIG. 7B is an isometric view of the anisotropic lattice structure of FIG. 7A after folding and jointing.

Figure 8A:
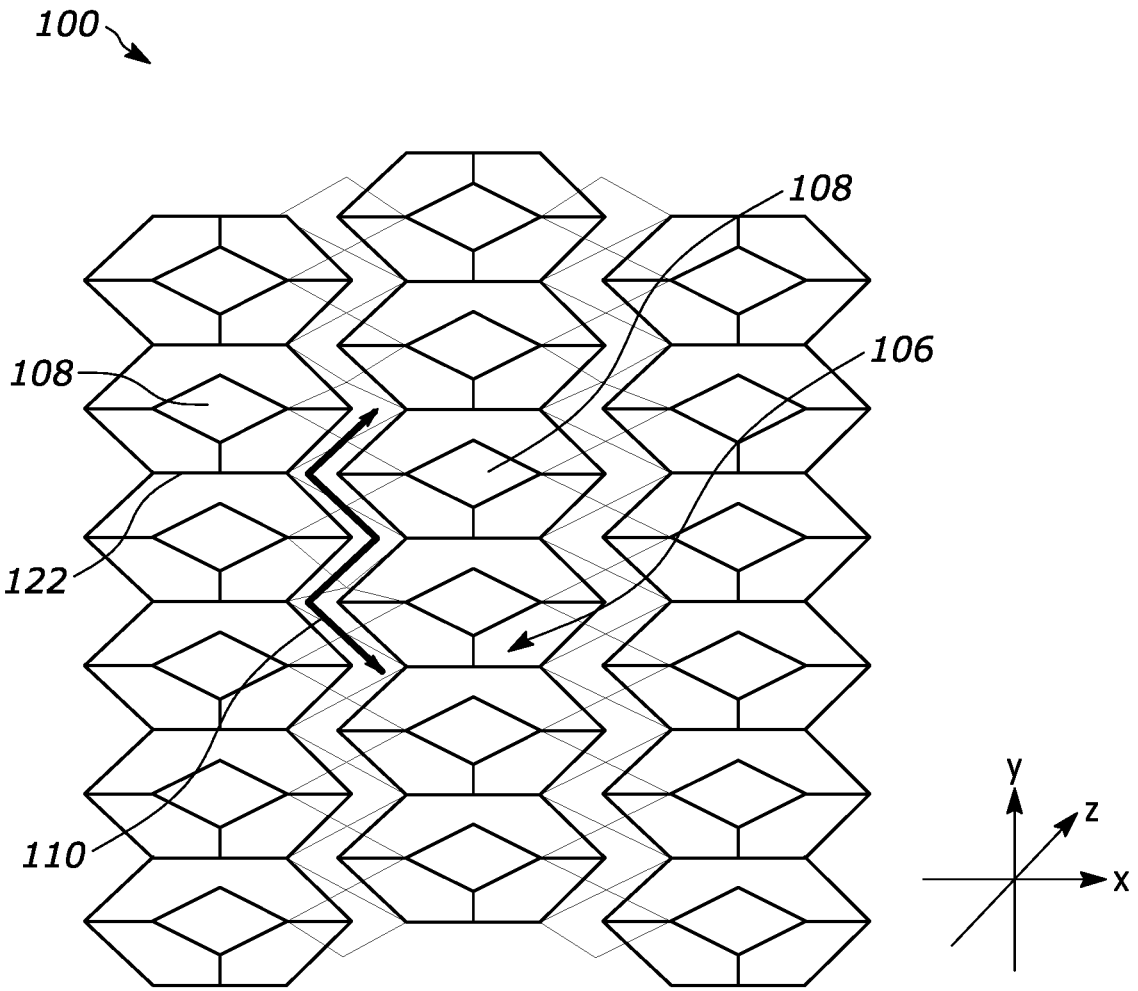
FIG. 8A is a top schematic view of the second layer of the first anisotropic lattice structure depicted in FIGS. 1-6 with adjacent exterior cells interconnected along a second axis.
Figure 8B:
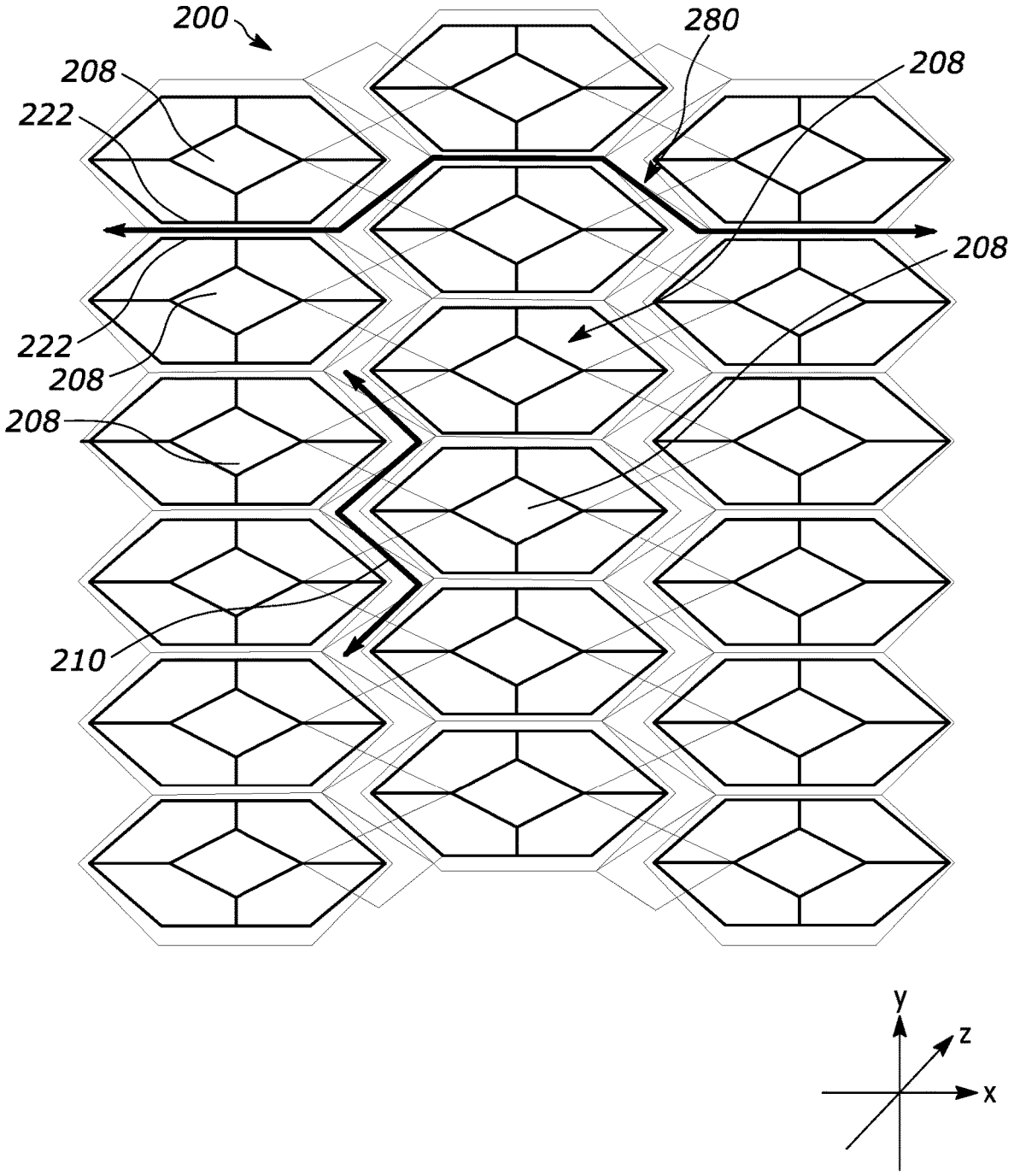
FIG. 8B is a top schematic view of a second layer of a second anisotropic lattice structure similar to that depicted in FIG. 9A but adjacent exterior cells unconnected along the second axis.

FIG. 8A illustrates schematically the second layer 106 of the first anisotropic lattice structure 100 in a manner like the depiction described with respect to FIG. 3A above. FIG. 8B illustrates schematically a second anisotropic lattice structure 200. The second anisotropic lattice structure 200 is substantially similar to the first anisotropic lattice structure 100. Elements of the second anisotropic lattice structure 200 depicted in FIG. 8B are designated by similar reference numbers indicated on the arrangements illustrated in FIGS. 1-8A increased by 100. Accordingly, these features will not be described in substantial detail. Further, it is appreciated that any combination or sub-combination of features described in regard to the first anisotropic lattice structure 100 may be incorporated into the second anisotropic lattice structure 200, and vice versa.

As shown, the second anisotropic lattice structure 200 includes second layer 206 that is disposed on and overlays the first layer 202. The second layer 206 is located above the first layer 202 on a third axis (the z-axis) that is perpendicular to both the first axis (the x-axis) and the second axis (the y-axis). The second layer 206 includes a plurality of exterior cells 208 arranged along the first axis and the second axis. Unlike the first anisotropic lattice structure 100 depicted in FIG. 8A, where adjacent exterior cells 108 along the first axis are unconnected and adjacent exterior cells 108 along the second axis are interconnected, adjacent exterior cells 208 in the second lattice structure 200 depicted in FIG. 8B are unconnected along both the first and second axes.

More specifically, adjacent exterior cells 208*a* and 208*c* along the second axis are unconnected so do not share a portion of the upper tubular frame 122 that is oriented along the first axis or a portion of the lower tubular frame 130 as described with respect to the first lattice structure 100. Instead, each of the adjacent exterior cells 208 has an upper tubular frame 222 that is offset from the upper tubular frame 222 of other adjacent exterior cells 208, and a lower tubular frame 230 that is offset from the lower tubular frame 230 of other adjacent exterior cells 208. (The lower tubular frame 230 is not visible in FIG. 8B because it is located below the upper tubular frame 222 but is substantially similar to the lower tubular frame depicted in FIGS. 4A and 4B). Therefore, the second lattice structure 200 includes both a plurality of first channels 210 and a plurality of second channels 280. As a result, the second lattice structure 200 has greater freedom of movement along the first and second axes than the first lattice structure 100 and provides greater flexibility.

Figure 9:
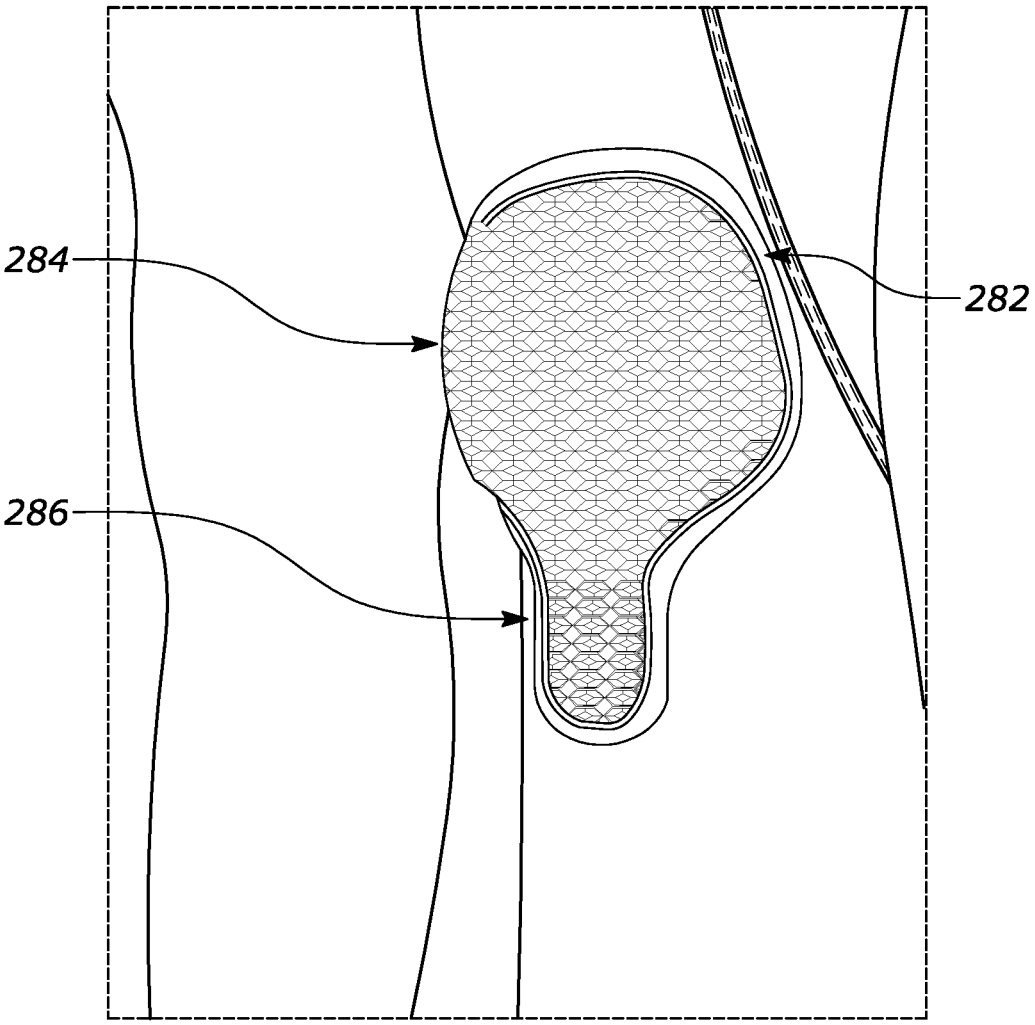
FIG. 9 is a perspective view of a protective pad for a knee on a mannequin, the protective pad including both the first and second anisotropic lattice structures of FIGS. 9A and 9B.
Figure 10:
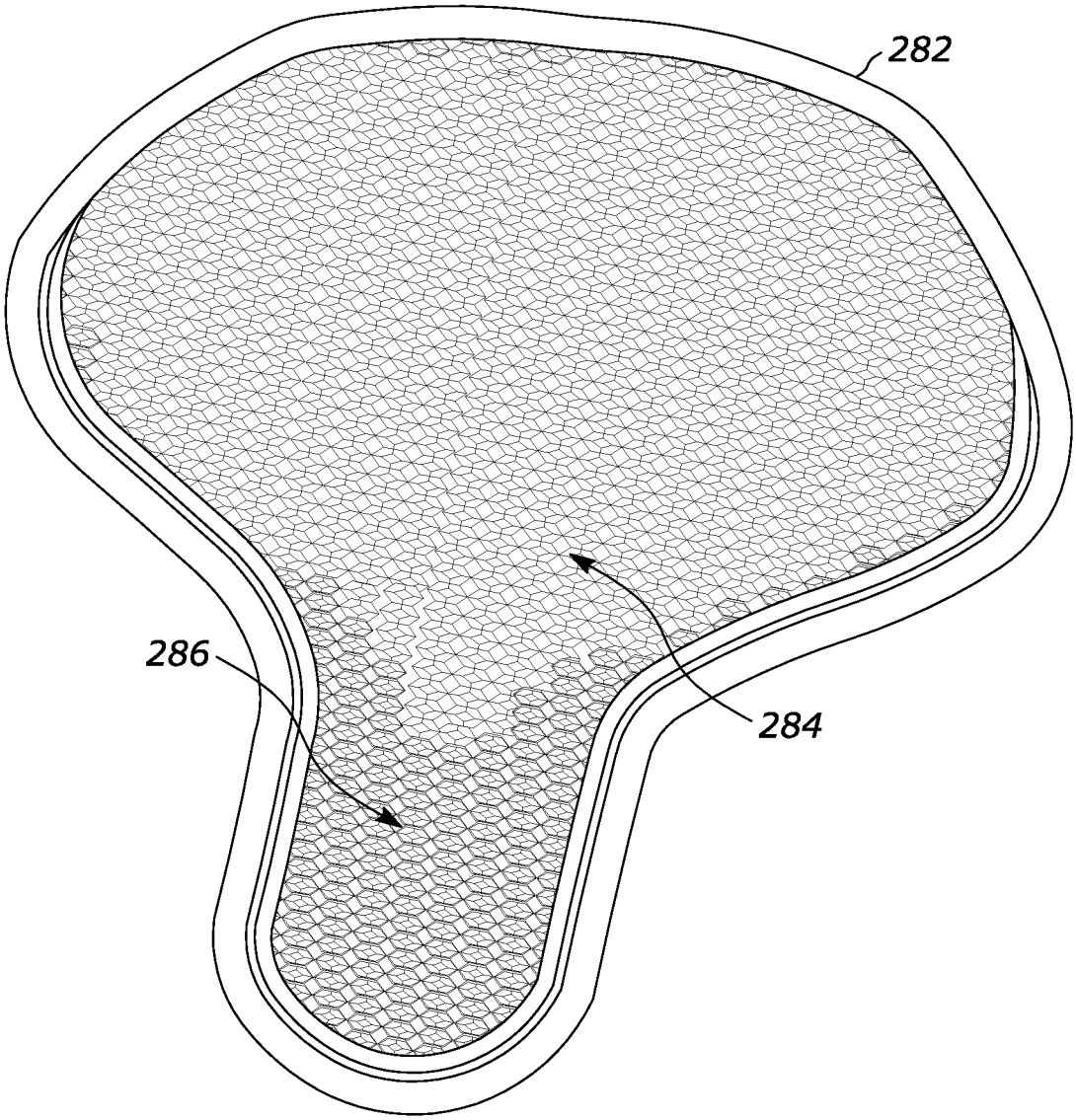
FIG. 10 is a perspective view of the protective pad of FIG. 10 illustrating a first area including the first anisotropic lattice structure and a second area including the second anisotropic lattice structure.
Figure 11:
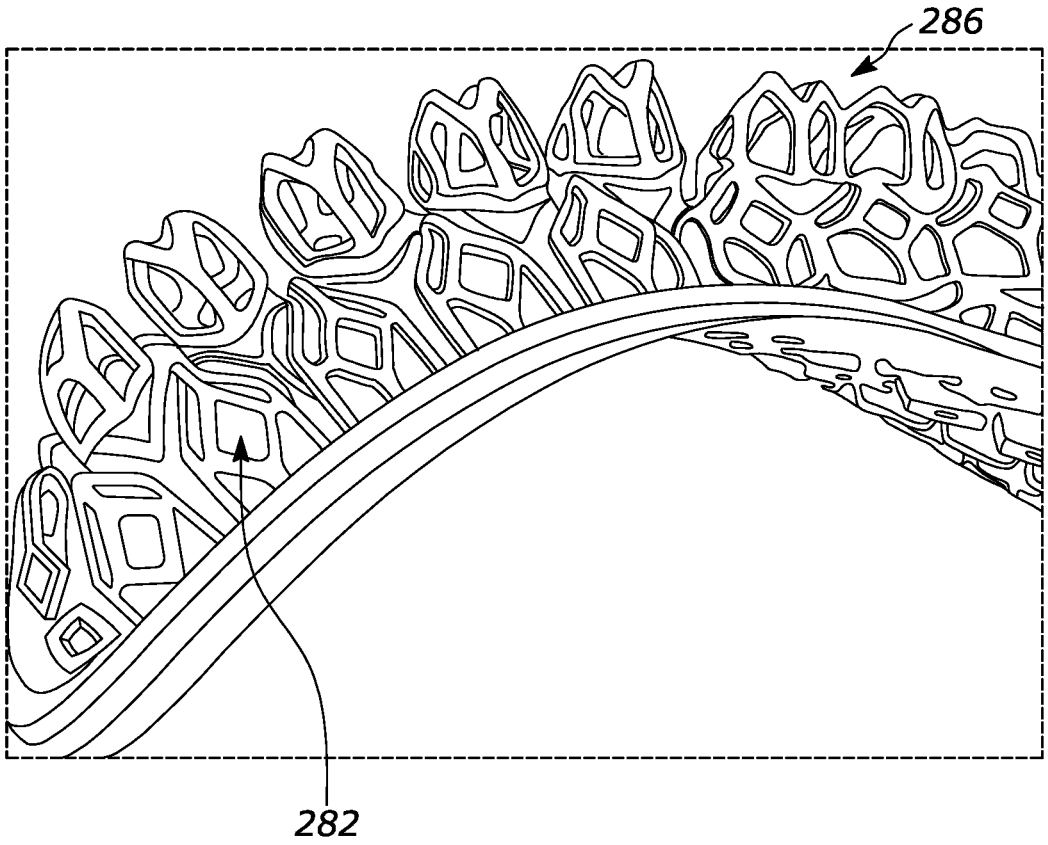
FIG. 11 is a perspective side view of the protective pad of FIGS. 10 and 11.

Turning to FIGS. 9-11, a composite structure 282 is depicted that is formed from both the first lattice structure 100 and the second lattice structure 200. Here, the composite structure 282 is a knee pad depicted on a mannequin. The first lattice structure 100 is used in a first area 284 of the composite structure 282 that benefits from the stability of additional structural connections, and the second lattice structure 200 is used in a second area 286 that benefits from greater flexibility. For example, when the composite structure 282 is a protective pad for a knee as shown, the first area 284 covers and protects the knee cap of a wearer with the stability of additional structural connections and the second area 286 is located below the knee cap to facilitate bending of the knee by the wearer. FIG. 11 illustrates the flexibility of the second area 286 as a result of use of the second lattice structure 200 in the composite structure 286.

In the composite structure 286, the first lattice structure 100 may be integral with the second lattice structure 200 or may be formed separately and later connected. The composite structure 286 includes at least a first area 284 of the first lattice structure 100 and a second area 284 of the second lattice structure 200 but may also optionally include additional areas with the first lattice structure 200, second lattice structure 200, another type of lattice structure, or a different structure or material.

Figure 12:
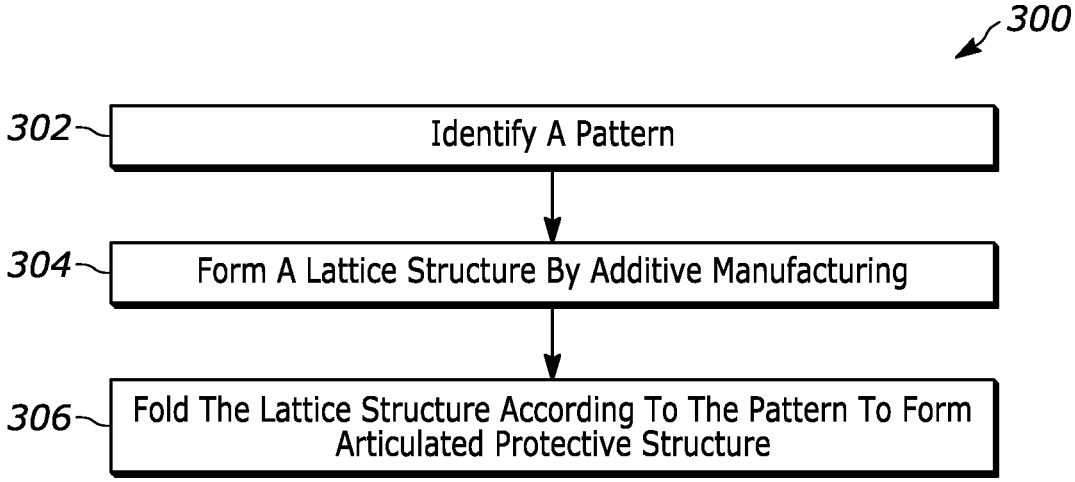
FIG. 12 illustrates schematically a method of manufacturing a protective pad including a lattice structure.

FIG. 12 illustrates schematically a method 300 of manufacturing a protective pad including a lattice structure (such as first anisotropic lattice structure 100, second lattice structure 200, or a composite structure 286). At box 302, the method 300 includes identifying a pattern for a lattice structure to facilitate folding the lattice structure to form an articulated protective structure. The articulated protective structure may be configured to protect a human body part, such as the groin or breasts. The pattern may include tabs (such as tabs 202) for connecting areas of the first lattice structure 100 and/or second lattice structure 200 during folding. At box 304, the method 300 includes forming a first lattice structure 100, second lattice structure 200, or composite structure 286 by additive manufacturing. As described above the first lattice structure 100 includes a first layer 102 including a plurality of interior cells 104, a second layer 106 disposed on and overlaying the first layer 102 and including a plurality of exterior cells 108, and a plurality of channels 110 formed between unconnected adjacent exterior cells 108 above interconnected adjacent interior cells 104. The second lattice structure 200 includes a first layer 202 including a plurality of interior cells 204, a second layer 206 disposed on and overlaying the first layer 202 and including a plurality of exterior cells 208, and a plurality of channels 210 and a plurality of channels 280 formed between unconnected adjacent exterior cells 108 above interconnected adjacent interior cells 104. The composite structure 286 includes a first area 284 with the first lattice structure 100 and a second area 284 with the second lattice structure 200. At box 306, the method includes folding the lattice structure (i.e., lattice structure 100, lattice structure 200, or a composite structure 284 including both the lattice structure 100 and the lattice structure 200) according to the pattern to form the articulated protective structure. In some executions, the articulated protective structure may be secured within a garment. In some executions, the lattice structure may be secured within a housing comprising an air-permeable fabric such as mesh.

In additional executions, the method 300 may include providing a molded form. In some executions, providing a molded form includes milling a three-dimensional shape mimicking a human body part. The method 300 may include warping the first lattice structure 100, the second lattice structure 200, and/or a composite structure including both the first lattice structure 100 and the second lattice structure 200 by placing the chosen lattice structure over the molded form during heat curing. In some executions, the first layer is placed adjacent the molded form during the warping of the chosen lattice structure.

An additive manufacturing technique of the foregoing method(s) using additive manufacturing and/or 3D printing may be any additive manufacturing technique or process that builds three-dimensional objects by adding successive layers of material on a material. The additive manufacturing technique may be performed by any suitable machine or combination of machines. The additive manufacturing technique may typically involve or use a computer, three-dimensional modeling software (e.g., Computer Aided Design, or CAD, software), machine equipment, and layering material. Once a CAD model is produced, the machine equipment may read in data from the CAD file and layer or add successive layers of liquid, powder, sheet material (for example) in a layer-upon-layer fashion to fabricate a three-dimensional object. The additive manufacturing technique may include any of several techniques or processes, such as, for example, a stereolithography ("SLA") process, a fused deposition modeling ("FDM") process, multi-jet modeling ("MJM") process, a selective laser sintering ("SLS") process, an electronic beam additive manufacturing process, and an arc welding additive manufacturing process. In some embodiments, the additive manufacturing process may include a directed energy laser deposition process. Such a directed energy laser deposition process may be performed by a multi-axis computer-numerically-controlled ("CNC") lathe with directed energy laser deposition capabilities.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings. Additionally, the described embodiments/examples/implementations should not be interpreted as mutually exclusive, and should instead be understood as potentially combinable if such combinations are permissive in any way. In other words, any feature disclosed in any of the aforementioned embodiments/examples/implementations may be included in any of the other aforementioned embodiments/examples/implementations.

The benefits, advantages, solutions to problems, and any element(s) that may cause any benefit, advantage, or solution to occur or become more pronounced are not to be construed as a critical, required, or essential features or elements of any or all the claims. The claimed invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially", "essentially", "approximately", "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

The patent claims at the end of this patent application are not intended to be construed under 35 U.S.C. § 112(f) unless traditional means-plus-function language is expressly recited, such as "means for" or "step for" language being explicitly recited in the claim(s).

What is claimed is:

1. A lattice structure comprising:

a first layer including a plurality of interior cells arranged along a first axis and a second axis that is perpendicular to the first axis, adjacent interior cells along the first axis being interconnected and adjacent interior cells along the second axis being interconnected;

a second layer disposed on and overlaying the first layer and located above the first layer, the second layer including a plurality of exterior cells arranged along the first axis and the second axis, adjacent exterior cells along the first axis being unconnected, the second layer forming a top of the lattice structure; and a channel formed between unconnected adjacent exterior cells above interconnected adjacent interior cells, wherein each interior cell has a plurality of compound connections, each compound connection directly connected by a base tubular extension to a base eye, by a base segment to a base tubular frame, and by a joining tubular extension to a lower eye of an exterior cell, the compound connection defining a bottom of the channel.

2. The lattice structure of claim 1, wherein adjacent exterior cells along the second axis are interconnected.

3. The lattice structure of claim 1, wherein adjacent exterior cells along the second axis are unconnected, wherein the channel is a first channel formed by the adjacent exterior cells along the first axis being unconnected, and wherein the lattice structure further includes a second channel formed by the adjacent exterior cells along the second axis being unconnected.

4. The lattice structure of claim 2, wherein each exterior cell has an upper tubular frame and a lower tubular frame, the adjacent exterior cells along the second axis being interconnected by sharing a portion of the upper tubular frame that is oriented along the first axis and a portion of the lower tubular frame that is oriented along the first axis.

5. The lattice structure of claim 1, wherein the adjacent exterior cells along the first axis are offset from one another along the second axis.

6. The lattice structure of claim 3, wherein the adjacent exterior cells along the second axis are offset from one another along the first axis.

7. The lattice structure of claim 1, wherein each exterior cell has an upper tubular frame and a lower tubular frame, a portion of the upper tubular frame and the lower tubular frame that is not oriented along the first axis defining a side of the channel.

8. The lattice structure of claim 1, wherein each interior cell has a base tubular frame, the adjacent interior cells along the second axis being interconnected by sharing a portion of the base tubular frame that is oriented along the first axis.

9. The lattice structure of claim 1, wherein each exterior cell has a central axis, an upper eye defined by a tubular structure surrounding the central axis and having a first opening at the central axis, the upper eye positioned at a top of the second layer, upper tubular extensions connected to the upper eye, the upper tubular extensions extending downward from the upper eye, an upper tubular frame having upper segments, the upper segments connected to one another and to the upper tubular extensions at upper joints, the upper segments connected to one another and unconnected to the upper tubular extensions at frame connections, the upper joints disposed above the frame connections, a lower tubular frame having lower segments, the lower segments connected to one another and to the upper segments at the frame connections, the lower segments connected to one another and unconnected to the upper segments at lower joints, the frame connections disposed above the lower joints, lower tubular extensions connected to the lower tubular frame at the lower joints, the lower tubular extensions extending downward from the lower joints, and a lower eye defined by a tubular structure surrounding the central axis and having a second opening at the central axis, the lower eye connected to the lower tubular extensions.

10. The lattice structure of claim 1, wherein each interior cell has a central axis, a base eye defined by a tubular structure surrounding the central axis and having a base opening at the central axis, the base eye positioned at a bottom of the first layer, base tubular extensions connected to the base eye and extending upward, a base tubular frame having base segments, the base segments connected only to one another and to the base tubular extensions at base joints, a dampening tubular frame having dampening extensions, the dampening extensions connected to the base segments at base connections, the base connections disposed above the base joints, and joining tubular extensions configured to connect to the second layer, the joining tubular extensions connected to the dampening extensions at dampening joints, the dampening joints disposed above the base connections, the joining tubular extensions connected to the base segments and the base tubular extensions at compound connections.

11. A lattice structure comprising:

a first layer including a plurality of cells arranged along a first axis and a second axis that is perpendicular to the first axis, adjacent cells of the first layer along the first axis being interconnected and adjacent cells of the first layer along the second axis being interconnected;

a second layer disposed on and overlaying the first layer, the second layer including a plurality of cells arranged along the first axis and the second axis, adjacent cells of the second layer along the first axis being unconnected, the second layer forming a top of the lattice structure; and a channel formed between unconnected adjacent cells of the second layer and interconnected adjacent cells of the first layer, wherein each cell of the second layer has an upper tubular frame and a lower tubular frame, a portion of the upper tubular frame and the lower tubular frame that is not oriented along the first axis defining a side of the channel.

12. The lattice structure of claim 11, wherein adjacent cells of the second layer along the second axis are interconnected.

13. The lattice structure of claim 11, wherein adjacent cells of the second layer along the second axis are unconnected, wherein the channel is a first channel formed by the adjacent cells of the second layer along the first axis being unconnected, and wherein the lattice structure further includes a second channel formed by the adjacent cells of the second layer along the second axis being unconnected.

14. The lattice structure of claim 11 including a first area wherein adjacent cells of the second layer along the second axis are interconnected and a second area wherein adjacent cells of the second layer along the second axis are unconnected.

15. The lattice structure of claim 11, wherein each cell of the second layer have an upper tubular frame and a lower tubular frame, the adjacent cells of the second layer along the second axis being interconnected by sharing a portion of the upper tubular frame that is oriented along the first axis and a portion of the lower tubular frame that is oriented along the first axis.

16. The lattice structure of claim 11, wherein each cell of the second layer have an upper tubular frame that is not shared with an adjacent cell and a lower tubular frame that is not shared with an adjacent cell.

17. The lattice structure of claim 11, wherein the adjacent cells of the second layer along the first axis are offset from one another along the second axis.

18. The lattice structure of claim 11, wherein each cell of the first layer has a base tubular frame, the adjacent cells of the first layer along the second axis being interconnected by sharing a portion of the base tubular frame that is oriented along the first axis.

19. The lattice structure of claim 11, wherein each cell of the first layer has a plurality of compound connections, each compound connection connected by a base tubular extension to a base eye, by a base segment to a base tubular frame, and by a joining tubular extension to a lower eye of a cell of the second layer, the compound connection defining a bottom of the channel.

20. A method of manufacturing a protective pad including an lattice structure, the method comprising:

identifying a pattern for a lattice structure to facilitate folding the lattice structure to form an articulated protective structure;

forming the lattice structure by additive manufacturing according to the pattern, the lattice structure including a first layer including a plurality of interior cells, a second layer disposed on and overlaying the first layer and including a plurality of exterior cells, the second layer forming a top of the lattice structure, and a plurality of channels formed between unconnected adjacent exterior cells above interconnected adjacent interior cells, each of the plurality of channels having a zig-zag pattern to allow freedom of movement along two axes; and folding the lattice structure according to the pattern to form the articulated protective structure.

21. The method of claim 20, wherein the articulated protective structure is configured to protect a human body part.

22. The method of claim 20, wherein the pattern includes tabs for connecting areas of the lattice structuring during folding.

23. The method of claim 20, wherein the articulated protective structure is secured within a garment.

24. The method of claim 20 further comprising securing the lattice structure within a housing comprising air-permeable fabric.

25. The method of claim 24, wherein the air-permeable fabric is mesh.

* * * * *